US006004658A

United States Patent [19]

Owada et al.

[11] Patent Number: 6,004,658

[45] Date of Patent: Dec. 21, 1999

[54] INTERMEDIATE TRANSFERRING MEDIUM FOR THERMAL TRANSFER PRINTER

[75] Inventors: Isao Owada; Hiroyoshi Zama, both of Iwate-ken; Makoto Satoh; Noboru Shimamoto, both of Gunma-ken; Kouichi Dobashi, Iwate-ken, all of Japan

[73] Assignees: Alps Electric Co., Ltd.; Shinetsu Chemical Co., Ltd., both of Japan

[21] Appl. No.: 08/864,047

[22] Filed: May 27, 1997

[30] Foreign Application Priority Data

May 30, 1996 [JP] Japan ..... 8-136256

[51] Int. Cl.[6] ..... B41M 5/00

[52] U.S. Cl. ..... 428/212; 428/195; 428/216; 428/217; 428/447; 428/913; 428/914

[58] Field of Search ..... 8/471; 428/195, 428/913, 914, 212, 213, 215–217, 447; 156/235; 503/227

[56] References Cited

FOREIGN PATENT DOCUMENTS 7-101086 4/1995 Japan ..... 503/227

*Primary Examiner*—Bruce H. Hess
*Attorney, Agent, or Firm*—Brinks Hofer Gilson & Lione

[57] ABSTRACT

The potency to be written via ink during recording so as to write the ink image and the re-transferability during re-transferring of the ink image on a recording medium should be retained, securely, for a long term. The transferring layers of the intermediate transferring medium comprise surface layer and intermediate layer, wherein the material of the surface layer comprises a silicone rubber containing 1 to 20 parts by weight of a non-reactive organopolysiloxane of a viscosity of 100 to 100,000 at 25° C. per 100 parts by weight of an addition-type silicone rubber with no inorganic filler; and the material of the intermediate layer comprises a silicone rubber containing 1 to 20 parts by weight of a non-reactive organopolysiloxane of a viscosity of 100 to 100,000 at 25° C. per 100 parts by weight of an addition-type silicone rubber.

6 Claims, 1 Drawing Sheet

INTERMEDIATE TRANSFERRING MEDIUM FOR THERMAL TRANSFER PRINTER

BACKGROUND OF THE INVENTION

1. Field of the Invention

The present invention relates to an intermediate transfer substance for thermal transfer printer, being capable of speedily recording a high-quality image on a recording medium such as plain paper or bond paper.

2. Description of the Prior Art

Conventional thermal transfer printers have generally been configured such that the molten ink on the ink ribbon is softened on the thermal head to transfer the ink for recording on a recording medium such as paper.

So as to effect high-quality image recording (printing) by such general thermal transfer printers, specific recording media of smooth surface have been used.

So as to effect high-quality image recording with no defect such as void on inexpensive recording media with larger irregularity on the surface, such as plain paper and bond paper, in recent years, a thermal transfer printer of intermediate transfer type has been proposed, wherein the ink on the ink ribbon is melted via exothermic heat from the thermal head and is once thermally transferred and recorded onto an intermediate transferring medium with silicone rubber surface in the form of roll or belt, to write the ink image (primary record image) on the intermediate transferring medium. Then, the ink image written on the intermediate transferring medium is re-transferred on a recording medium.

The intermediate transferring medium to be used for the thermal transfer printer of such intermediate transfer type should be imparted with the property to be written via ink during recording so as to write the ink image and the property of re-transferability during re-transferring so as to re-transfer the ink image on a recording medium. During re-transferring in particular, the intermediate transferring medium should have higher surface releasability.

As disclosed in Japanese Patent Laid-open No. Hei 5(1993)-338368, an intermediate transferring medium has been proposed as one of conventional examples to satisfy such demand, having a transfer layer produced by adding a releasing agent such as dimethyl silicone oil, reactive silicone oil for amino modification or epoxy modification, and carnauba-modified silicone oil solid at 100° C. or less into silicone rubber so as to improve the releasability of silicone rubber.

Such intermediate transferring medium with the transfer layer formed from the silicone rubber into which such conventional releasing agent have been added has improved ink releasability and thus effects high-quality image printing on recording media such as plain paper and bond paper, compared with the intermediate transferring medium with a transfer layer formed from general silicone rubber.

Such conventional intermediate transferring medium has excellent effects such that the substance can securely retain the re-transferability during re-transferring for a long term, and additionally, the substance can effect printing of high-quality image on recording media such as plain paper and bond paper with larger irregularity. Furthermore because the transfer pressure during re-transferring can be set low, the size and structural strength of a thermal transfer printer using the intermediate transferring medium can be reduced, concurrently, which very effectively reduces the size and cost of the thermal transfer printer.

So as to confer better performance, recently, thermal transfer printers have been consistently improved. As the thermal transfer printers have got better performance, an intermediate transferring medium for such printers should be required to securely retain the potency to be written via ink during recording so as to write the ink image and the re-transferability during re-transferring of the ink image on a recording medium, for a long term.

SUMMARY OF THE INVENTION

It is an object of the present invention to provide an intermediate transferring medium for thermal transfer printer, being capable of securely retaining the potency to be written via ink during recording so as to write the ink image as well as the re-transferability during re-transferring of the ink image on a recording medium, for a long term.

DESCRIPTION OF THE PREFERRED EMBODIMENTS

One embodiment of the intermediate transferring medium for thermal transfer printer in accordance with the present invention will now be described with reference to FIG. 1.

Figure 1:
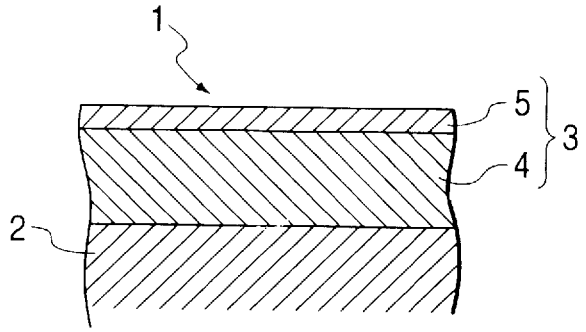
FIG. 1 is a schematic view depicting one embodiment of the intermediate transferring medium for thermal transfer printer in accordance with the present invention.

FIG. 1 is a schematic view depicting one embodiment of the intermediate transferring medium for thermal transfer printer in accordance with the present invention.

In one embodiment of the present invention, intermediate transferring medium 1 for thermal transfer printer is configured overall in the form of roll, wherein the outer peripheral face of metal roll 2 approximately in a cylindrical form is covered with transferring layer 3 made of rubber. According to the outcome of experiments, preferably, the transferring layers 3 should be configured such that the layers are composed of two layers of intermediate layer 4 and surface layer 5 in this order from the outer peripheral face of the metal roll 2.

The intermediate layer 4 is formed on the outer peripheral face of the metal roll 2, thereby improving the adhesivity of thermal head 6 described below onto the intermediate transferring medium 1 to stably transfer the ink onto the intermediate transferring medium 1, wherein the load during re-transferring can be reduced and be uniform, thereby improving the re-transferability and additionally wherein so as to supply a releasing agent in a stable manner onto the surface layer 5, it is important that the intermediate layer 4 is 0.1- to 3.0-mm thick and is made of an addition-type silicone rubber of rubber hardness of 15 to 70 (JIS A), the silicone rubber containing a non-reactive organopolysiloxane represented by the following formula (1);

(1)

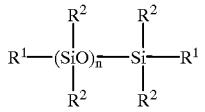

According to the results of experiments, the intermediate layer 4 is preferably about 0.5-mm thick and is made of an addition-type silicone rubber of rubber hardness of 30 (JIS A), containing the non-reactive organopolysiloxane represented by the above formula (1).

In one embodiment, the intermediate layer 4 comprises such addition-type silicone rubber blended with a non-reactive organopolysiloxane, namely 6 mol % diphenyl silyxane-containing methyl phenyl polysiloxane of a viscosity of 2000 cps at 25° C. of which both the ends are sealed with trimethylsilyl group, at a ratio of 10 parts by weight of the methyl phenyl polysiloxane to 100 parts by weight of the addition-type silicone rubber.

Essentially, the surface layer 5 should have good potency to be written via ink during recording so as to write the ink image on the intermediate transferring medium 1 together with good re-transferability during re-transferring of the ink image on recording medium 7. In the present embodiment, the surface layer 5 comprises an addition-type silicone rubber of about 40-$\mu$mm thickness and rubber hardness of about 31 (JIS A) and with no inorganic filler contained therein, and the aforementioned addition-type silicone rubber is produced by blending 5 parts by weight of 6 mol % diphenylsilyxane-containing methyl phenyl polysiloxane as a non-reactive organopolysiloxane represented by the formula (1), having a viscosity of 2,000 cps at 25° C. and both the ends sealed with trimethylsilyl group, into 100 parts by weight of an addition-type silicone rubber with no inorganic filler contained therein, which addition-type silicone rubber is produced by blending (a) 2.2 parts by weight of organohydrodiene polysiloxane represented by the following formula (4);

(4)

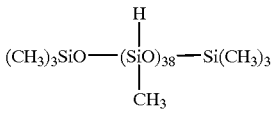

as an organohydrodiene polysiloxane represented by the following formula (2);

(2)

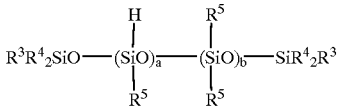

and (b) 0.5 part by weight of a 2 wt % alcohol solution of chloroplatinic acid as a hydrosilylating reaction catalyst into (c) 100 parts by weight of dimethyl polysiloxane of a viscosity of 400 cps at 25° C. and with both the ends sealed with dimethylvinylsilyl group, as an alkenyl group-containing organopolysiloxane.

The intermediate transferring medium 1 of such composition if used for thermal transfer printer 8, can securely have the potency to be written via ink during recording so as to write the ink image and the re-transferabilityduring re-transferring of the ink image on recording medium 7, for a long term. The intermediate transferring medium 1 can additionally effect high-quality image printing on the recording medium 7 such as plain paper and bond paper.

The non-reactive organopolysiloxane represented by the formula (1) and contained in the surface layer and intermediate layer of the transferring layers is a characteristic component in accordance with the present invention, contributing greatly to the improvement of the ink releasability on the transferring layers.

In the formula (1), $R^1$ represents a monovalent hydrocarbon group with no unsaturated aliphatic group, including for example alkyl groups such as methyl group, ethyl group and propyl group; and alkyl groups which hydrogen atoms bonded to the carbon atom are partially or wholly substituted with fluorine atom, such as 3,3,3-trifluoropropyl group. Preference is given to methyl group. Further, $R^2$ is methyl group or phenyl group, and the four $R^2$s may be the same or different. Among all the $R^2$s in each molecule of the non-reactive organopolysiloxane, it is required that 1 to 30 mol %, preferably 3 to 15 mol % thereof is occupied by phenyl group. If the content of phenyl group is less than 1 mol %, the compatibility of the resulting individual non-reactive organosiloxane molecules with the alkenyl group-containing organopolysiloxane described below as the base component of the addition-type silicone rubber is elevated, so that the organopolysiloxanes are readily incorporated into the base component and are thus hardly bled out into the surface layer of the transferring layers to form a uniform release layer.

If the content of phenyl group exceeds 30 mol %, the compatibility with the alkenyl group-containing organopolysiloxane is so low that the bleed out of the non-reactive organopolysiloxane occurs at such an excessive degree that the writing potency is deteriorated or uniform release layer cannot be formed or stable releasability cannot be retained for a long term because the releasability prominently changes, disadvantageously. By defining the content of phenyl group at 1 to 30 mol % as has been described above, excess bleed out of the releasing agent can be prevented to form a uniform release layer with no exception, so that satisfactory releasability can be procured in terms of initial performance and durability.

Furthermore, the viscosity of the non-reactive organopolysiloxanes is preferably 100 to 100,000 cps, more preferably 300 to 10,000 cps at 25° C., from the respect of procurement of good releasability. If the viscosity of the non-reactive organopolysiloxane is less than 100 cps, the non-reactive organopolysiloxane is incorporated into the base material addition-type silicone rubber so that the releasing effect is unlikely to be exhibited; if the viscosity of the non-reactive organopolysiloxane is more than 100,000 cps, the bleed out rate into the surface layer is so slow that the release layer is unlikely to be effectively formed on the surface layer.

Preferably, the content of the non-reactive organopolysiloxane in the addition-type silicone rubber is 1 to 20 parts by weight to 100 parts by weight of the addition-type silicone rubber in any of the surface layer and intermediate layer composing the transferring layers of the intermediate transferring medium. More preferably, the content is 5 to 15 parts by weight. If the content of the non-reactive organopolysiloxane in the addition-type silicone rubber is less than one part by weight, the initial releasability is good but stable releasability can hardly be retained for a long term. If the content of the non-reactive organopolysiloxane in the addition-type silicone rubber is above 20 parts by weight, the properties of the base material addition-type silicone rubber are deteriorated, such as the reduction of the strength and hardness thereof. For example, the abrasion resistance is distinctively reduced in the surface layer due to the decrease of the strength.

Furthermore, the content of the non-reactive organopolysiloxane in the addition-type silicone rubber within a range of 1 to 20 parts by weight may be the same or different in between the surface layer and intermediate layer composing the transferring layers of the intermediate transfer substance. So as to prevent the deterioration of the properties of the surface layer and retain good balanced releasability for a long term, herein, the content of the non-reactive organopolysiloxane is higher in the intermediate layer than in the surface layer.

Importantly, the silicone rubber to be used in the surface layer of the intermediate transferring medium for thermal transfer printer in accordance with the present invention contains the following components;

(a) alkenyl group-containing organopolysiloxane;

(b) organohydrodiene polysiloxane; and (c) a hydrosilylating reaction catalyst.

The silicone rubber should be an addition-type silicone rubber of a composition never containing any inorganic filler such as silica. Inorganic fillers are generally contained in routine silicone rubber. If such inorganic filler is added therein, the releasability is then distinctively reduced.

As one component composing the addition-type silicone rubber never containing any inorganic filler, the alkenyl group-containing organopolysiloxane (a) to be used in the intermediate transferring medium for thermal transfer printer in accordance with the present invention has for example a unit structure —$R^6R^7SiO$— wherein $R^6$ and $R^7$ are alkyl groups such as methyl group, ethyl group and propyl group; alkyl groups which hydrogen atoms bonded to the carbon atom are partially or wholly substituted with fluorine atom such as 3,3,3-trifluoropropyl group; and an alkenyl group with 2 to 3 carbon atoms such as vinyl group and allyl group. Preferably, $R^6$ and $R^7$ are methyl group and vinyl group, in particular. Furthermore, the end is for example dimethylvinylsilyl group and trimethylsilyl group. The viscosity of the alkenyl group-containing organopolysiloxane (a) is 100 to 100,000 cps, particularly preferably 300 to 10,000 cps at 25° C. Still further, the alkenyl group-containing organopolysiloxane (a) preferably has two or more alkenyl groups within the molecule.

As a component of the addition-type silicone rubber never containing any inorganic filler to be used in the surface layer of the intermediate transferring medium for thermal transfer printer in accordance with the present invention, the organohydrodiene polysiloxane (b) acts as a crosslinking agent on the component alkenyl group-containing organopolysiloxane (a). Any organohydrodiene polysiloxane may be used, with no specific limitation, if the polysiloxane has two hydrogen atoms bonded to the silicon atom. Preferably, the polysiloxane is represented by the formula (2).

In the formula (2), $R^3$ is hydrogen atom or monovalent hydrocarbon group with no unsaturated aliphatic group contained therein, and as such monovalent hydrocarbon group, for example, there are illustrated alkyl groups such as methyl group, ethyl group and propyl group; alkyl groups which hydrogen atoms bonded to the carbon atom are partially or wholly substituted with fluorine atom, such as 3,3,3-trifluoropropyl group. Particularly preferably, $R^3$ is hydrogen atom or methyl group.

In the formula (2), $R^4$ and $R^5$ are monovalent hydrocarbon group with no unsaturated aliphatic group, such as those illustrated for $R^3$, and methyl group is particularly preferable.

So as to form a desirable transferring layers from the component (b) cross-linked with the component (a), "a" is an integer of 3 or more and "b" is an integer of 0 or more in the formula 2. So as to elevate the adhesivity of the materials composing the surface layer of the transferring layers onto the underlining intermediate layer thereby effectively exerting the effect of increasing the releasability from ink, the cross-linking density should be raised. Hence, the ratio a/(a+b) is preferably 0.7 or more to 1.0 or less.

Generally, the organohydrodiene polysiloxane (b) described above is preferably at a viscosity of 1,000 cps or less at 25° C. Additionally, the organohydrodiene polysiloxane (b) is blended at a ratio such that the number of hydrogens bonded to the silicon atom is preferably at least one, particularly preferably one to five per one alkenyl group in the alkenyl group-containing organopolysiloxane as the component (a).

As a component composing the addition-type silicone rubber with no inorganic filler contained therein, which is to be used in the surface layer of the intermediate transferring medium layer for thermal transfer printer in accordance with the present invention, the hydrosilylating reaction catalyst (c) is a catalyst propagating the addition reaction (hydrosilylation) between the component (a) and the component (b); generally, use is made of platinum-group metal catalysts well known to a person with ordinary skill in the art, such as platinum, palladium and rhodium; preferably, use is made of platinum catalysts, in particular. The platinum catalysts include for example platinum black, chloroplatinic acid, a complex of chloroplatinic acid with an olefin such as ethylene, alcohol, aldehyde, vinyl silane or vinyl siloxane. These hydrosilylating reaction catalysts (c) may be blended at an amount of generally 1 to 500 ppm, preferably 5 to 20 ppm on platinum metal basis, to 100 parts by weight of the component (a).

To the addition-type silicone rubber with no inorganic filler contained therein, which is to be used in the surface layer of the intermediate transferring medium for thermal transfer printer in accordance with the present invention, may be added a reaction suppressant for suppressing addition reaction, for example, methylvinylcyclotetrasiloxane, acetylene alcohols, and siloxane-modified acetylene alcohols.

So as to elevate the adhesivity with the surface layer, very importantly, the silicone rubber to be used in the intermediate layer of the intermediate transferring medium for thermal transfer printer in accordance with the present invention should be an addition-type silicone rubber of a composition containing the alkenyl group-containing organopolysiloxane (a), the organohydrodiene polysiloxane (b), the hydrosilylating reaction catalyst (c) and a filler (d).

The alkenyl group-containing organopolysiloxane (a) as the component of the addition-type silicone rubber to be used in the intermediate layer of the intermediate transferring medium for thermal transfer printer in accordance with the present invention has for example a unit structure —$R^6R^7SiO$— wherein $R^6$ and $R^7$ are alkyl groups such as methyl group, ethyl group and propyl group; alkyl groups which hydrogen atoms bonded to the carbon atom are partially or wholly substituted with fluorine atom such as 3,3,3-trifluoropropyl group; and an alkenyl group with 2 to 3 carbon atoms such as vinyl group and allyl group. Preferably, $R^6$ and $R^7$ are particularly methyl group and vinyl group. Furthermore, the end is for example dimethylvinylsilyl group and trimethylsilyl group. The viscosity of the alkenyl group-containing organopolysiloxane (a) is 100 to 100,000 cps, particularly preferably 300 to 10,000 cps at 25° C. Still further, the alkenyl group-containing organopolysiloxane (a) preferably has two or more alkenyl groups within the molecule.

As a component of the addition-type silicone rubber to be used in the surface layer of the intermediate transferring medium for thermal transfer printer in accordance with the present invention, the organohydrodiene polysiloxane (b) is represented by the following formula (3);

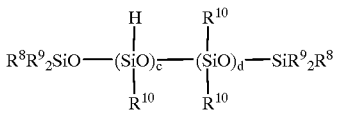

(3)

and acts as a crosslinking agent on the component alkenyl group-containing organopolysiloxane (a). Any organohydrodiene polysiloxane may be used, with no specific limitation, if the polysiloxane has two hydrogen atoms bonded to the silicon atom.

In the formula (3), $R^8$ is hydrogen atom or monovalent hydrocarbon group with no unsaturated aliphatic group contained therein, and as such monovalent hydrocarbon group, for example, there are illustrated alkyl groups such as methyl group, ethyl group and propyl group; alkyl groups which hydrogen atoms bonded to the carbon atom are partially or wholly substituted with fluorine atom, such as 3,3,3-trifluoropropyl group. Particularly preferably, $R^8$ is hydrogen atom or methyl group. In the formula (3), furthermore, $R^9$ and $R^{10}$ are monovalent hydrocarbon group with no unsaturated aliphatic group, such as those illustrated for $R^8$, and methyl group is particularly preferable. In the formula (3), still furthermore, "c" and "d" are independently an integer of 1 or more.

Generally, the organohydrodiene polysiloxane (b) described above is preferably at a viscosity of 1,000 cps or less at 25° C. Additionally, the organohydrodiene polysiloxane (b) is blended at a ratio such that the number of hydrogens bonded to silicon atom is preferably at least one, particularly preferably one to five per one alkenyl group in the alkenyl group-containing organopolysiloxane as the component (a).

As a component composing the addition-type silicone rubber with no inorganic filler contained therein, which is to be used in the surface layer of the transferring layers for thermal transfer printer in accordance with the present invention, the hydrosilylating reaction catalyst (c) is a catalyst propagating the addition reaction (hydrosilylation) between the component (a) and the component (b); generally, use is made of platinum-group metal catalysts well known to a person with ordinary skill in the art, such as platinum, palladium and rhodium; particularly, use is made of platinum catalysts preferably. The platinum catalysts include for example platinum black, chloroplatinic acid, a complex of chloroplatinic acid with an olef in such as ethylene, alcohol, aldehyde, vinylsilane or vinylsiloxane. These hydrosilylating reaction catalysts (c) may be blended at an amount of generally 1 to 500 ppm, preferably 5 to 20 ppm on platinum metal basis into 100 parts by weight of the component (a).

The filler (d) as one component of the addition-type silicone rubber to be used in the intermediate layer of the intermediate transferring medium for thermal transfer printer in accordance with the present invention may be blended, if necessary, from the respect of improving the mechanical strength of silicone rubber and the thermal conductivity thereof and procuring electric conductivity. Various fillers to be used for routine silicone rubber may be used satisfactorily.

The filler includes for example reinforcing fillers such as fumed silica, precipitated silica, carbon powder, titanium dioxide, and quartz powder; thermally conductive fillers such as aluminium oxide, boron nitride, aluminium nitride, and magnesium oxide; conductive fillers such as carbon black, nickel, silver, and silver-coated glass surface.

To the addition-type silicone rubber to be used in the intermediate layer of the intermediate transferring medium for thermal transfer printer in accordance with the present invention may be added a reaction suppressant for suppressing addition reaction, for example, methylvinylcyclotetrasiloxane, acetylene alcohols, and siloxane-modified acetylene alcohols. Additionally, heat-resistance improving agents and fire retardancy improving agents may be added into the rubber satisfactorily.

The individual layers of the transferring layers of the intermediate transferring medium for thermal transfer printer in accordance with the present invention are independently not limited to be prepared as a single layer; for example, the surface layer may be prepared as two layers or the intermediate layer may be of a bilayer structure. The individual layers may be of a multilayer structure, if necessary.

The surface layer of the transferring layers of the intermediate transferring medium for thermal transfer printer in accordance with the present invention may be formed by generally well known processes such as spray coating, dip coating and knife coating.

Furthermore, the intermediate transferring medium 1 overall may be of a belt form, by covering the outer peripheral face of the belt base comprising a metal belt with no end or seamless film of for example polyimide by the transferring layers 3.

One example of thermal transfer printer 8 using the intermediate transferring medium 1 of the present embodiment is described with reference to FIG. 2.

Figure 2:
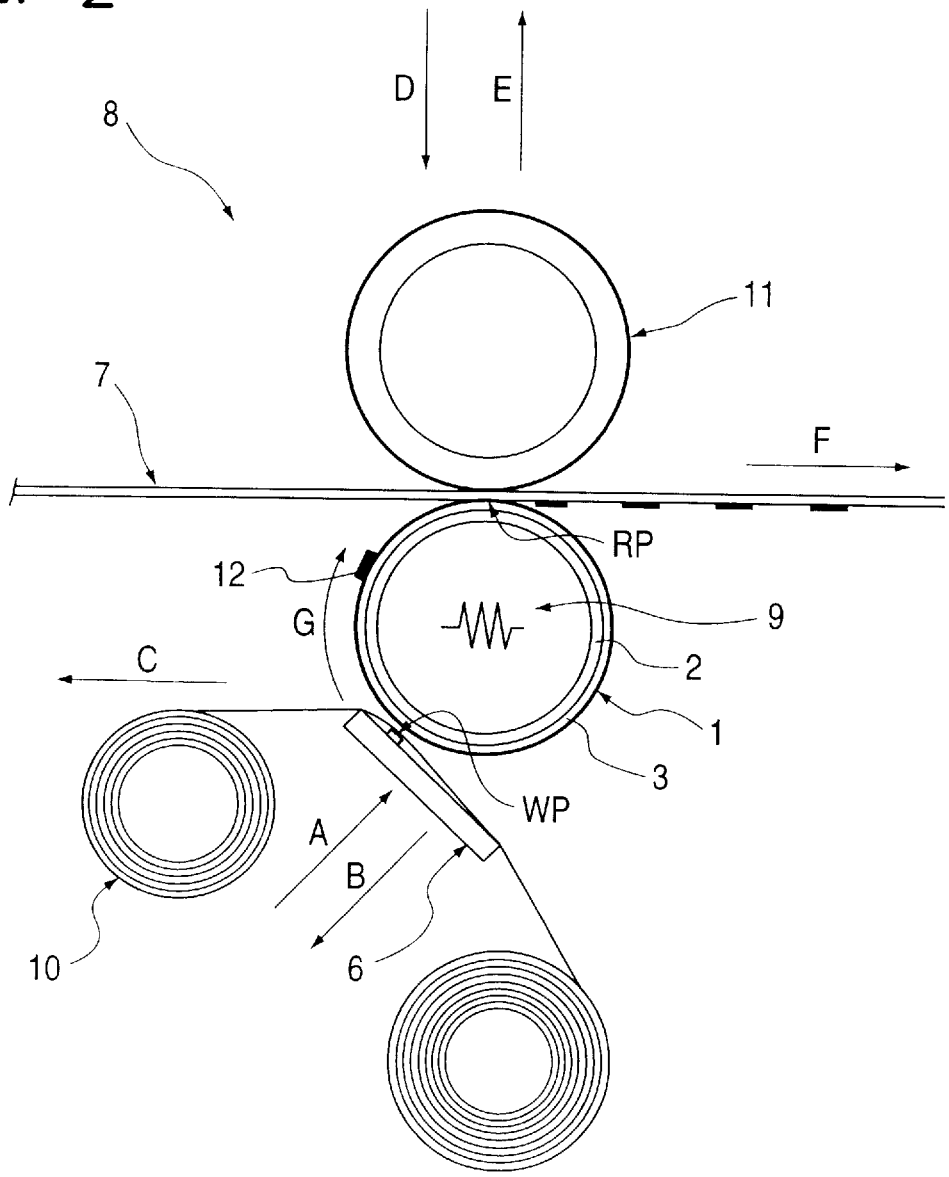
FIG. 2 is a structural view depicting the main part of one embodiment of a thermal transfer printer using the intermediate transferring medium of the present invention.

FIG. 2 depicts a structural view of the main part of one embodiment of the thermal transfer printer using the intermediate transferring medium in accordance with the present invention.

As shown in FIG. 2, the thermal transfer printer 8 of the present embodiment includes the intermediate transferring medium 1 arranged in the printer body (not shown in the figure). The intermediate transferring medium 1 has a function of platen called as transfer platen in a cylindrical shape, and the intermediate transferring medium 1 is revolvable when the driving force from a driving source (not shown in the figure) such as stepping motor is transmitted to the intermediate transferring medium 1. Also, the outer peripheral face of the transferring layers 3 of the intermediate transferring medium 1 is smooth; inside the intermediate transferring medium 1 is arranged heater 9 giving the ink writing (transferring) temperature to the intermediate transferring medium 1 and the ink re-transferring and fixing temperature to recording medium 7, to control the surface temperature of the intermediate transferring medium 1 at about 50° C.

By preparing the metal roll 2 composing the intermediate transferring medium 1 as a cartridge heater comprising an electric wire embedded in a metal body, structurally, it not necessary to arrange heater 9 inside the intermediate transferring medium 1.

Thermal head 6 is arranged downward the left diagonal side of the intermediate transferring medium 1. The thermal head 6 is detachable from the intermediate transferring medium 1 by a driving mechanism not shown in the figure, as shown by arrows A and B in FIG. 2. Additionally, a plurality of exothermic elements (not shown in the figure) are arranged on the thermal head 6, and can generate heat selectively on the basis of the printing information. Then, transfer position WP of the intermediate transferring medium 1 to be written via the ink on ink ribbon 10 corresponds to the point to attach the thermal head 6 in contact to the intermediate transferring medium 1.

The ink ribbon 10 is fed in between the intermediate transferring medium 1 and the thermal head 6. As shown by arrow C in FIG. 2, structurally, the ink ribbon 10 can run from the bottom toward the left diagonal upward position, and the ribbon is sequentially wound up in the left direction as shown in FIG. 2. Further, a desirable hot-melt ink is coated on the surface of the ink ribbon 10 facing the intermediate transferring medium 1 at the transfer position WP (not shown in the figure).

Freely revolvable pressure roller 11 comprising a metal roll formed in an approximately cylindrical shape is arranged above the intermediate transferring medium 1. As shown by arrows D and E in FIG. 2, the pressure roll 11 is freely movable upward and downward via a driving mechanism not shown in the figure, so that the pressure roller might be freely detachable from the intermediate transferring medium 1. Then, the position on which the pressure roller 11 is in contact to the intermediate transferring medium 1 is defined as re-transfer position RP to re-transfer ink image 12 via the ink on the ink ribbon 10 onto the surface of the intermediate transferring medium 1 in transfer position WP.

Herein, the pressure roller 11 might be of a structure with a heater inside or of a structure such that the outer peripheral face of a metal roller formed with a circular cross section is covered with rubber, and the roller is not specifically limited to the structure of the present embodiment.

Recording medium 7 such as plain paper and bond paper is to be fed (paper feeding) in between the intermediate transferring medium 1 and the pressure roller 11. As shown by arrow F in FIG. 2, the recording medium 7 is fed from left, then passing through the intermediate transferring medium 1 and the pressure roller 11, to freely run to the right side.

With reference to FIG. 2, the printing operation of the thermal transfer printer 8 of the structure described above in the present embodiment is now described.

When the thermal transfer printer 8 in th e present embodiment initiates printing operation, firstly, the ink ribbon 10 and the intermediate transferring medium 1 are in contact to each other under pressure through the thermal head 6, while the intermediate transferring medium 1 is imparted with a degree of temperature which might possibly not melt the ink on the ink ribbon 10, from the heater 9 arranged inside the intermediate transferring medium 1. On the basis of the printing information, at such state, the exothermic element (not shown in the figure) of the thermal head 6 is selectively heated then, and the ink on the ink ribbon 10 is softened or melted to transfer the ink onto the surface of the transferring layers 3 of the intermediate transferring medium 1, where the ink is primarily preserved to form ink image 12 called as primary record image.

Then, the ink image 12 is sequentially formed on the surface of the intermediate transferring medium 1, following the clockwise rotation of the intermediate transferring medium 1 as shown by arrow G in FIG. 2.

Subsequently, on a transfer mechanism (not shown in the figure) transferring the ink ribbon 10 through wear driving between the intermediate transferring medium 1 and the ink ribbon 10, the ink ribbon 10 is sequentially wound up into the direction depicted by the arrow C in FIG. 2.

In this case, the winding rate of the ink ribbon 10 running along the direction shown by the arrow C varies, depending on the winding radius toward the winding side shown left in FIG. 2. The winding rate of the ink ribbon 10 is set to be slightly faster than the revolution rate of the intermediate transferring medium 1 shown by the arrow G in FIG. 2. The difference in the rates can be absorbed by a slip mechanism arranged on the transfer mechanism on the winding side of the ink ribbon 10 (both mechanisms not shown in the figure).

Then, by shifting the pressure roller 11 into the direction shown by the arrow D in FIG. 2, the heater 9 arranged inside the intermediate transferring medium 1 is heated while bringing the recording medium 7 in contact to the ink image 12 written on the intermediate transferring medium 1 under pressure. Following the revolution of the intermediate transferring medium 1, subsequently, the ink image 12 written on the surface of the intermediate transferring medium 1 is serially re-transferred and fixed on the recording medium 7, via the pressure supplied from the pressure roller 11 and the heat fed from the heater 9, while the recording medium 7 is shifted in the direction shown by arrow F in FIG. 2, whereby recording is effected on the recording medium 7.

After completion of the whole recording (printing process) on the recording medium 7, additionally, the pressure roller 11 is shifted along the direction shown by the arrow E in FIG. 2 and is dissociated from the intermediate transferring medium 1, so the recording medium 12 is discharged.

For color printing by means of the thermal transfer printer 8 in the present embodiment, further, the aforementioned printing process should be carried out plural times corresponding to the number of plural inks on a full-color ink ribbon (not shown in the figure), to overlap plural colors for color printing.

When using a full-color ink ribbon with three colors, namely Y (yellow), M (magenta; purple red) and C (cyan; blue green), the recording operation should be repeated three times, while the recording operation should be repeated four times when using a full-color ink ribbon with four colors, namely Y, M, C and Bk (black).

For effecting such color recording, the printing process should be repeated plural times, corresponding to the number of ink colors. Therefore, the recording medium 7 is back fed in a direction adverse to the direction shown by arrow F in FIG. 2, while the thermal head 6 proceeds toward the direction shown by the arrow B in FIG. 2, to consequently set free the thermal head 6 from the state in contact to the intermediate transferring medium 1. At that state, a color ink ribbon runs along the direction shown by the arrow C in FIG. 2, to expose the head of next color ink to effect the printing process by means of the next color.

After completion of the printing processes corresponding to all colors, the pressure roller 11 proceeds toward the direction shown by the arrow E in FIG. 2 and is then dissociated from the intermediate transferring medium 1, to discharge the recording medium 7.

For back feeding the recording medium 7 for color recording, the pressure roller 11 structurally back feeds the recording medium 7 while kept at the same state as in printing process, but the pressure roller 11 structurally may have a weak contact force under pressure toward the intermediate transferring medium 1 during the back feeding of the recording medium 7. Structurally, the back feeding of the recording medium 7 for color recording may be carried out by means of a paper feed system (not shown in the figure) dedicated only to back feeding.

As the performance test of the intermediate transferring medium 1 in the present embodiment, the durability (life) was tested and assessed.

The durability test was conducted as follows; mounting the intermediate transferring medium 1 of the present embodiment onto the thermal transfer printer 8 with monochrome ink sheet, setting the surface temperature of the intermediate transferring medium 1 at 55° C. and the load (transfer pressure) during re-transferring at 3 kg/cm, a given pattern was recorded on the recording medium 7. Whenever 5000 sheets were recorded as the recording medium 7, the ink remaining on the surface of the intermediate transferring medium 1 after re-transferring was ranked as two stages; ○; no ink residue, x; ink residue. As the recording medium 7 used for the assessment, two types of paper were used; XEROX 4024 (Trade name; manufactured by Xerox, Co., Ltd.(U.S.A)) as plain paper, and Lancaster bond paper (Trade name; manufactured by Gilbert Co., Ltd. (U.S.A)) as bond paper. The results of the assessment are shown in the following Table 1.

TABLE 1

| | Recording sheet (in number) | | | | | | | | |
|---|---|---|---|---|---|---|---|---|---|
| | Initial stage | 5000 | 10000 | 15000 | 20000 | 25000 | 30000 | 35000 | 40000 |
| Recording medium A | ○ | ○ | ○ | ○ | ○ | ○ | ○ | ○ | ○ |
| Recording Medium B | ○ | ○ | ○ | ○ | ○ | ○ | ○ | ○ | ○ |

In Table 1, the recording medium A is XEROX 4024 (Trade name; manufactured by Xerox, Co., Ltd.);

the recording medium B is Lancaster bond paper (Trade name; manufactured by Gilbert Co., Ltd. );

symbol ○ represents the absence of ink residue after re-transferring; and x represents the presence of ink residue after re-transferring.

As shown in the results of the assessment in Table 1, the intermediate transferring medium 1 in the present embodiment caused no ink residue on the surface of the intermediate transferring medium 1 after re-transferring, even after recording was effected on 40,000 sheets; and the intermediate transferring medium 1 can securely keep the re-transferability during re-transferring of the ink image 12 onto the recording medium 7 for a long term and thus has a long life.

For comparison, the durability of the intermediate transferring medium shown below was assessed.

Comparative Embodiment

The intermediate transferring medium of the present Comparative Embodiment has an intermediate layer formed from an addition-type silicone rubber, the layer being of about 0.5 mm thickness and rubber hardness (JIS A) of about 30. The remaining structure is the same as in the above embodiment. The durability of the intermediate transferring medium was assessed, as shown in the following Table 2.

TABLE 2

| | Recording sheet (in number) | | | | | | | | |
|---|---|---|---|---|---|---|---|---|---|
| | Initial stage | 5000 | 10000 | 15000 | 20000 | 25000 | 30000 | 35000 | 40000 |
| Recording medium A | ○ | ○ | ○ | X | — | — | — | — | — |
| Recording Medium B | ○ | ○ | X | — | — | — | — | — | — |

In Table 2, the recording medium A is XEROX 4024 (Trade name; manufactured by Xerox, Co., Ltd.);

the recording medium B is Lancaster bond paper (Trade name; manufactured by Gilbert Co., Ltd. );

symbol ○ represents the absence of ink residue after re-transferring; and x represents the presence of ink residue after re-transferring.

As shown in the results of the assessment in Table 2, the intermediate transferring medium 1 of the Comparative Embodiment caused ink residue on the surface of the intermediate transferring medium after re-transferring, after recording was effected on 10,000 plain papers or 5,000 bond papers; and the intermediate transferring medium cannot securely keep the re-transferability during re-transferring of the ink image onto the recording medium, for a long term.

On comparison of the assessment results of the intermediate transferring medium 1 of the present invention as shown in Table 1 with the assessment results of the intermediate transferring medium of the Comparative Embodiment as shown in Table 2, it is indicated that the durability of the present medium is significantly different from that of the medium of the Comparative Embodiment, although the same surface layer 5 is used therein. This indicates that the intermediate layer 4 effectively functions as an internally added releasing agent-feeding layer for the surface layer 5 in the intermediate transferring medium 1 of the present invention.

Thus, the intermediate transferring medium 1 of the present invention securely can have the potency to be written via ink during recording so as to write an ink image and can have re-transferability during re-transferring so as to re-transfer the ink image onto the recording medium, for a long term.

What is claimed is:

1. An intermediate transferring medium comprising a substrate and transferring layers, wherein the transferring layers comprise a surface layer and an intermediate layer:

the material of the surface layer comprises a silicone rubber containing 1 to 20 parts by weight of a non-reactive organopolysiloxane of a viscosity of 100 to 100,000 cps at 25° C. and represented by the following formula (1);

(1)

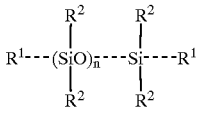

wherein $R^1$ is monovalent hydrocarbon group with no unsaturated aliphatic group; $R^2$ is methyl group or phenyl group, and all the individual $R^2$s may be the same or different; among all the $R^2$s in each molecule, 1 to 30 mol % thereof is occupied by phenyl group; and "n" is a positive integer per 100 parts by weight of an addition-type silicone rubber with no inorganic filler contained therein; and the material of the intermediate layer comprises a silicone rubber containing 1 to 20 parts by weight of anon-reactive organopolysiloxane of a viscosity of 100 to 100,000 cps at 25° C. per 100 parts by weight of an addition-type silicone rubber.

2. An intermediate transferring medium of thermal transfer printer according to claim 1, wherein the silicone rubber composing the surface layer in the transferring layers is of a thickness of 5 to 200 $\mu$m and rubber hardness of 10 to 50 (JIS A).

3. An intermediate transferring medium of thermal transfer printer according to claim 1, wherein the silicone rubber composing the intermediate layer in the transferring layers is of a thickness of 0.1 to 3.0 mm and rubber hardness of 15 to 70 (JIS A).

4. An intermediate transferring medium of thermal transfer printer according to claim 1, wherein the addition-type silicone rubber with no inorganic filler in the surface layer contains (a) an alkenyl group-containing orgnaopolysiloxane (b) an organohydrodiene polysiloxane, represented by the formula (2);

(2)

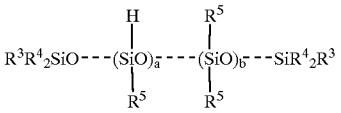

wherein $R^3$ is hydrogen atom or monovalent hydrocarbon group with no unsaturated aliphatic group con tained therein; $R^4$ and $R^5$ are monovalent hydrocarbon group with no unsaturated aliphatic group, and $R^4$ and $R^5$ may be the same or different; "a" is an integer of 3 or more and "b is an integer of 0 or more, provided that the ratio a/(a+b) is preferably 0.7 or more to 1.0 or less; and (c) a hydrosilylating reaction catalyst.

5. An intermediate transferring medium of thermal transfer printer according to claim 4, wherein the silicone rubber composing the surface layer in the transferring layers is of a thickness of 5 to 200 $\mu$m and rubber hardness of 10 to 50 (JIS A).

6. An intermediate transferring medium of thermal transfer printer according to claim 4, wherein the silicone rubber composing the intermediate layer in the transferring layers is of a thickness of 0.1 to 3.0 mm and rubber hardness of 15 to 70 (JIS A).

* * * * *

UNITED STATES PATENT AND TRADEMARK OFFICE

CERTIFICATE OF CORRECTION

PATENT NO. : 6,004,658
DATED : December 21, 1999
INVENTOR(S) : Isao Owada et al.

It is certified that error appears in the above-identified patent and that said Letters Patent is hereby corrected as shown below:

Claim 4,
Lines 2-3, after formula (2), delete "con tained" and substitute -- contained -- in its place.

Signed and Sealed this

Twenty-sixth Day of March, 2002

*Attest:*

*Attesting Officer*

JAMES E. ROGAN
*Director of the United States Patent and Trademark Office*